US011270830B2

(12) United States Patent
Liszewski et al.

(10) Patent No.: US 11,270,830 B2
(45) Date of Patent: Mar. 8, 2022

(54) DOUBLE-POLE VOLTAGE TRANSFORMER

(71) Applicant: ABB Schweiz AG, Baden (CH)

(72) Inventors: Piotr Liszewski, Przasnysz (PL); Jaroslaw Chorzepa, Przasnysz (PL)

(73) Assignee: ABB Schweiz AG, Baden (CH)

( * ) Notice: Subject to any disclaimer, the term of this patent is extended or adjusted under 35 U.S.C. 154(b) by 872 days.

(21) Appl. No.: 15/891,880

(22) Filed: Feb. 8, 2018

(65) Prior Publication Data

US 2018/0158589 A1 Jun. 7, 2018

Related U.S. Application Data

(63) Continuation of application No. PCT/PL2016/000065, filed on Jun. 24, 2016.

(30) Foreign Application Priority Data

Aug. 10, 2015 (PL) ..... 124310

(51) Int. Cl.
*H01F 27/02* (2006.01)
*H01F 27/06* (2006.01)
*H01F 38/26* (2006.01)

(52) U.S. Cl.
CPC ..... *H01F 27/022* (2013.01); *H01F 27/02* (2013.01); *H01F 27/06* (2013.01); *H01F 38/26* (2013.01)

(58) Field of Classification Search
CPC ..... H01F 27/02; H01F 27/022; H01F 27/04; H01F 27/06; H01F 27/327; H01F 38/26; H01F 2027/328

(Continued)

(56) References Cited

U.S. PATENT DOCUMENTS 7,808,360 B1 * 10/2010 Le ..... H01F 27/022 336/229
2014/0232509 A1 * 8/2014 Shaw ..... H01F 38/28 336/84 C

FOREIGN PATENT DOCUMENTS

CN 201489990 U 5/2010
CN 202134390 U 2/2012

(Continued)

OTHER PUBLICATIONS

European Patent Office, International Search Report & Written Opinion issued in corresponding Application No. PCT/PL2016/000065, dated Oct. 21, 2016, 10 pp.

(Continued)

*Primary Examiner* — Tszfung J Chan
(74) *Attorney, Agent, or Firm* — Leydig, Voit & Mayer, Ltd.

(57) ABSTRACT

The application invention generally deals with a double-pole voltage transformer enclosed in a tight enclosure made in the form of a resin cast comprising a central element integrated with a base and comprising circumferential sheds and two bushings situated above the circumferential sheds on the central element. The central element has the form of a circular cylinder situated with its side wall horizontally on the base plane, and the circumferential sheds are situated around the central element only in the area of the contact between the central element and the base, and above the circumferential sheds there are side elements of the cast forming side sheds, and above the side sheds there is situated a circumferential top shed surrounding a fragment of the side surface of the central element, and the bushings are detachably joined with the central element through projections respectively.

7 Claims, 3 Drawing Sheets

Figure 1:
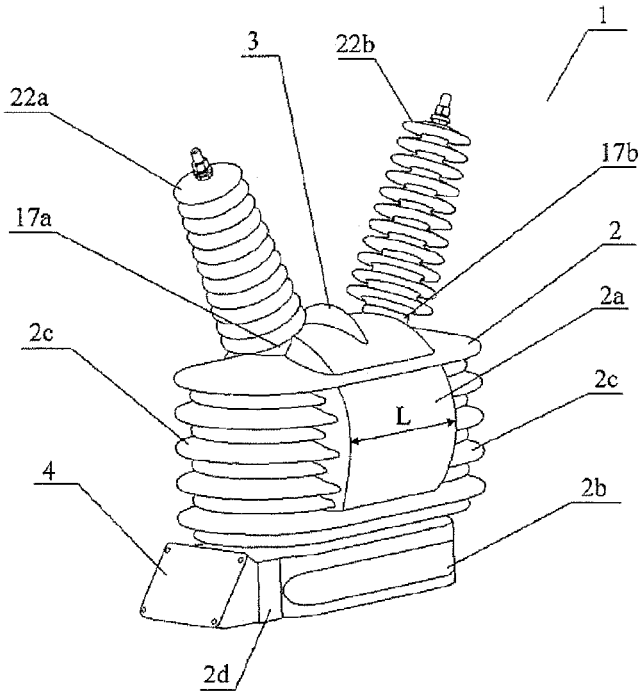

(58) Field of Classification Search
USPC ..... 336/90, 92, 94, 96
See application file for complete search history.

(56) References Cited

FOREIGN PATENT DOCUMENTS

| | | | | |
|---|---|---|---|---|
| CN | 202205569 | U | | 4/2012 |
| CN | 202633015 | U | * | 12/2012 |
| CN | 202633015 | U | | 12/2012 |
| CN | 203118750 | U | * | 8/2013 |
| CN | 203118750 | U | | 8/2013 |
| CN | 203733605 | U | | 7/2014 |
| CN | 203931778 | U | * | 11/2014 |
| CN | 203931778 | U | | 11/2014 |

OTHER PUBLICATIONS

Polish Patent Office, Search Report issued in corresponding Application No. W.124310, dated Jul. 24, 2017, 2 pp.
ABB: "Outdoor voltage transformer Type vol. 24 Medium Voltage Products," Jan. 24, 2014, XP055308108, Retrieved Oct. 6, 2016, from the Internet: https://library.e.abb.com/public/58424b6976f7e1bbc1257c6a0051e1a9/ABB_VOL-24-en.pdf.
ABB: "Medium Voltage Products," Feb. 9, 2011, XP055308085, Retrieved Oct. 6, 2016 from the Internet https://library.e.abb.com/public/fc93f2ea6ca6e130c1257832003543fa/TDO_6_ATOEN. pdf.

* cited by examiner

DOUBLE-POLE VOLTAGE TRANSFORMER

The invention deals with a MV single-phase double-pole voltage transformer in resin insulation. The voltage transformer is applicable in medium voltage measuring and protection electric power systems and as a power supply component in medium voltage switch-disconnector systems.

There is known a double-pole voltage transformer of the type TDO 6 manufactured by ABB s.r.o. org. Unit EJF. That transformer is tightly closed in an enclosure made as a resin cast comprising a central element in the shape of an elliptical cylinder fitted with circumferential sheds situated on the side surface of the cylinder perpendicularly to the longitudinal axis of the cylinder. The central element is situated with one base of the cylinder on an elliptical base and it is integrated with it. Additionally, the central element is integrated with two bushings situated above the circumferential sheds on the other base of the cylinder, this base being convex.

In the above presented solution, insulating bushings and the transformer body are connected with high voltage and low voltage coils in one resin cast, and the high voltage coil of the primary winding forms one whole with the insulating bushings. Making of the cast requires the use of expensive moulds, which increases the manufacturing costs. At the same time, the place where the bushings are joined with the body is a place of lowered mechanical strength of the cast, which can result in cracks in the resin in that place due to shrinkage of resin in the hardening process, caused by changes in temperature.

The essence of the invention is that a double-pole voltage transformer tightly closed in an enclosure made as a resin cast containing a central element integrated with a base and comprising circumferential sheds and two bushings situated above the circumferential sheds on the central element, is that the central element has the form of a circular cylinder situated with its side wall horizontally on the base plane, with the circumferential sheds placed around the central element only in the area of contact between the central element and the base, and above the circumferential sheds there are located side elements of the cast forming side sheds which are integrated with the front surfaces of the central element, and above the side sheds there is situated a circumferential top shed surrounding a fragment of the side surface of the central element, and the bushings are detachably joined with the central element by projections which are situated above the circumferential top shed and they are formed in the shape of truncated cones integrated with the central element, in which projections there are situated HV complete terminals.

Preferably the central element has a partition in the shape of a segment of a round shed and adjoining the upper surface of the central element in a plane perpendicular to the longitudinal axis of the central element, in the middle of its length "L".

Preferably the side walls of the base situated along the side walls of the central element are fitted with oblong sockets having the shape of semicircular longitudinal hollows.

Preferably the circumferential sheds, the side sheds and the circumferential top shed are situated parallel to one another and in planes parallel to the bottom surface of the base, and they have a fixed inter-shed spacing "S" and an alternately variable overhang "P1", "P2" between the adjacent sheds.

Preferably the longitudinal axes of the bushings are divergent to one another and they deviate from a vertical line in a plane parallel to the planes of the walls of the base by an angle β situated in a plane perpendicular to the bottom surface of the base. In their bottom part, the high voltage bushings have centrally situated cavities in the shape of truncated cones, which shape corresponds to the shape of the projections of the central element.

Preferably the contact surfaces between the projections and the cavities in the bushings are sealed with an insulating and sealing compound.

The advantage of the double-pole voltage transformer according to the invention is a reduction in its manufacturing cost, increased mechanical strength of the cast and elimination of the risk of damage to the place where the bushings are joined with the transformer body.

Figure 2:
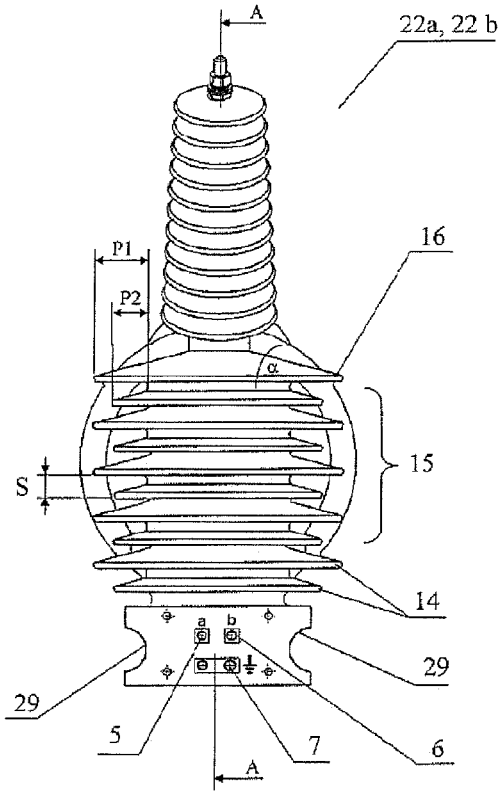
Figure 3:
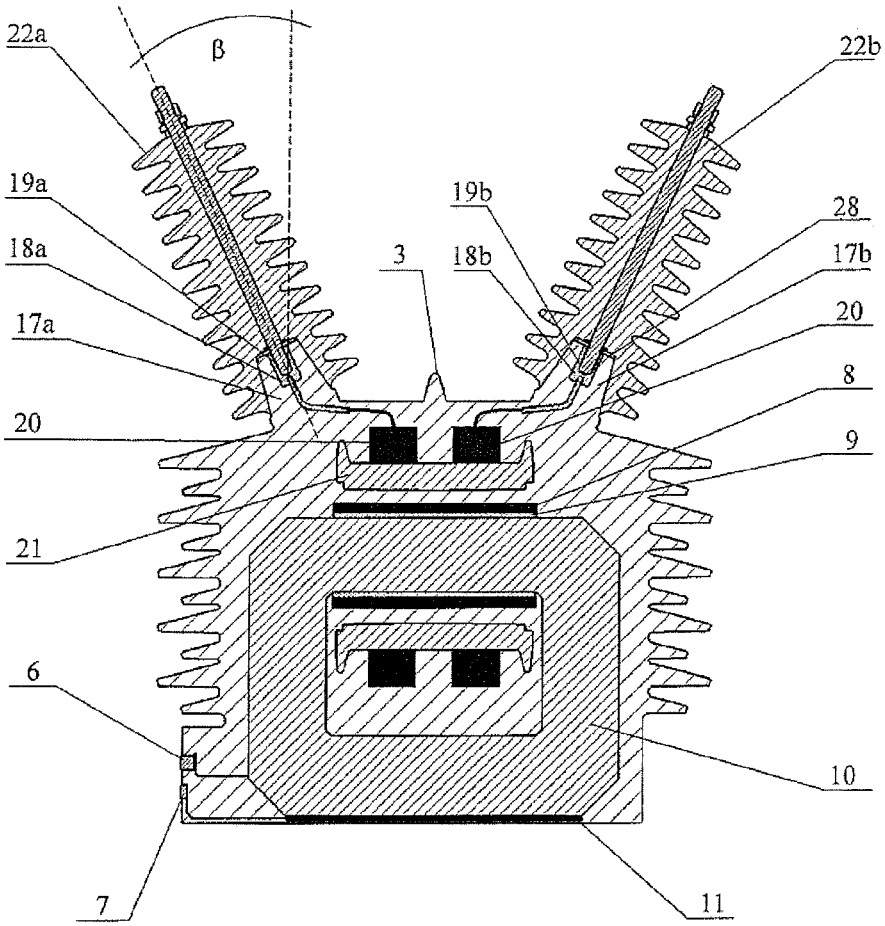
Figure 4:
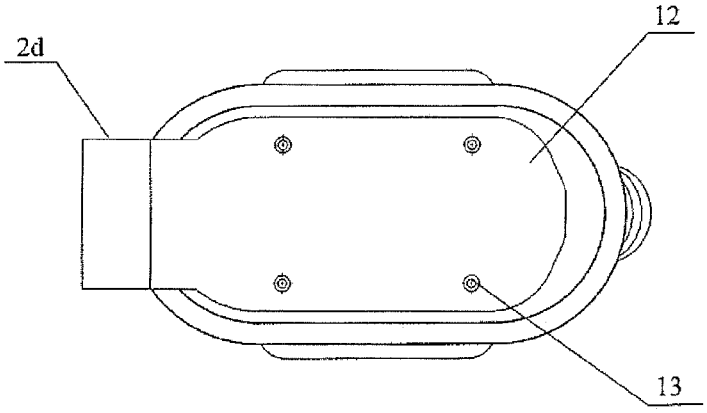
Figure 5:
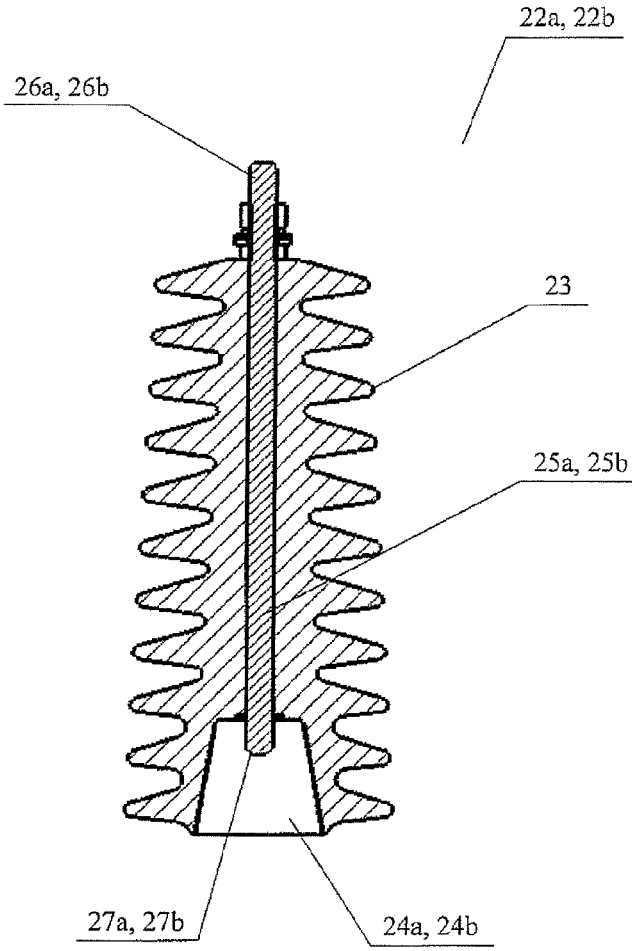

An embodiment of the invention is shown in the drawing, where:

FIG. 1—shows a front view of the transformer in isometric projection,

FIG. 2—shows the transformer after the terminal box has been removed, in a side view, FIG. 3—shows the transformer from FIG. 2, in section A-A, FIG. 4—shows the transformer in a bottom view, FIG. 5—shows the transformer bushing from FIG. 2, in section A-A.

The double-pole voltage transformer 1 comprises a tight enclosure 2 made as a resin cast with a central element 2*a*, a base 2*b* and side elements of the cast 2*c*.

The element 2*a* has the form of a circular cylinder situated horizontally on the base 2*b*. The base 2*b* has the form of a cuboid with rounded edges. A cuboidal side element 2*d* integrated with the base 2*b* adjoins the base, more specifically one of its side walls.

The element 2*a* of the transformer 1 has a partition 3 in the shape of a segment of a round shed adjoining the upper surface of the element 2*a*, in a plane perpendicular to the longitudinal axis of the element 2*a*, in the middle of its length "L" defined as the distance between the front surfaces of the cylinder of the central element 2*a*.

A terminal box 4 is attached to a side wall of the element 2*d* of the enclosure 2. Inside the box 4, in a side wall of the element 2*d* there are located two complete terminals nn 5, 6 and an earthing terminal 7. The terminals 5 and 6 are galvanically connected inside the enclosure 2 with a low voltage winding nn 8. The winding nn 8 is wound on an insulating tube 9 fixed on a core 10 secured in a yoke 11 located in the enclosure 2. The earthing terminal 7 is galvanically connected inside the enclosure 2 with the yoke 11 and the core 10.

On the bottom surface 12 of the base 2*b* there are located assembly elements 13 in the form of threaded conducting inserts which are used to fix the transformer 1 to a support structure in the form of a plate or rails, not shown in the drawing. The elements 13 are galvanically connected inside the enclosure 2 with the earthing terminal 7.

The place of contact of the side surface of the element 2*a* with the base 2*b* is screened by circumferential bottom sheds 14. Above the sheds 14 there are situated, on both sides, semicircular side sheds 15, over which, in the upper part of the enclosure 2, a circumferential upper shed 16 is situated.

The sheds 14, 15, 16 are situated parallel to one another and on planes parallel to the bottom surface 12 of the base 2*b* of the transformer 1, with a fixed inter-shed spacing S, angle of inclination of the sheds a and an alternating overhang P1, P2, with P1>P2.

Above the shed 16, at the place where it is joined to the surface of the central element 2*a* of the enclosure 2, there are situated projections 17*a* and 17*b* which are integrated with the central element 2*a* and which have the form of truncated cones. The projections 17*a* and 17*b* are situated symmetrically relative to the partition 3. Complete HV terminals 18*a* and 18*b*, fitted with threaded holes 19*a* and 19*b* respectively, are situated in the projections 17*a* and 17*b*. The terminal 18*a* is galvanically connected inside the enclosure 2 with the beginning of an HV winding 20, and the terminal 18*b* is galvanically connected inside the enclosure 2 with the end of the HV winding 20. The HV winding 20 is concentrically wound on a carcass 21. The carcass 21 is fixed on the core 10 concentrically and externally to the insulation tube 9.

Bushings WN 22*a* and 22*b* are detachably fixed on the projections 17*a* and 17*b*. The HV bushings 22*a*, 22*b* are made as resin casts fitted with circumferential bushing sheds 23. In the bases of the bushings 22*a*, 22*b*, there are cavities 24*a*, 24*b* respectively having the shapes of truncated cones situated coaxially to the longitudinal axis of the bushings 22*a*, 22*b*, and their shape corresponds to the shape of the projections 17*a*, 17*b*. In the longitudinal axes of the bushings 22*a*, 22*b* there are located conductive rods 25*a*, 25*b* respectively whose ends protrude outside the resin casts of the bushings 22*a*, 22*b* and they form first connections 26*a*, 26*b* and second connections 27*a*, 27*b* respectively. The connections 26*a*, 26*b*, 27*a* and 27*b* have threads, not shown in the drawing. The bushings 22*a* and 22*b* are fixed on the projections 17*a* and 17*b* respectively, by screwing the connections 27*a*, 27*b* located in the cavities 24*a*, 24*b* into the terminals 18*a* and 18*b*. The projections 17*a*, 17*b* fill the cavities 24*a*, 24*b* respectively, and the surfaces of contact between the external walls of the projections 17*a*, 17*b* respectively, and the surfaces of the cavities 24*a*, 24*b* are sealed with an insulating and sealing compound 28.

The longitudinal axes of the bushings 22*a*, 22*b* are divergent to each other and they coincide with the longitudinal axes of the projections 17*a* and 17*b* respectively and they deviate from a vertical line symmetrically with respect to the partition 3 in a plane parallel to the planes of the walls of the base 2*b* by an angle β situated in a plane perpendicular to the bottom surface 12 of the base 2*b*.

Sockets 29 for a mounting bracket, not shown in the drawing, are located on the side walls of the base 2*b* below the front surfaces of the element 2*a* screened by the circumferential sheds 14. The sockets 29 have the shape of semicircular longitudinal hollows. The diameter of the sockets 29 is selected to correspond to the diameter of the tubes of the mounting bracket, not shown in the drawing. The mounting bracket has a plate to which four arms in the form of tubes are attached. The mounting bracket makes it possible to turn the transformer 1 in a plane perpendicular to the longitudinal axis of the sockets 29, in order to set the transformer up in such way that the projections 17*a*, 17*b* point downwards. Such position of the transformer is necessary for a proper distribution of the sealing compound 28 when the connections 27*a* and 27*b* are screwed onto the terminals 18*a* and 18*b* respectively, so that the compound 28 does not overflow from the cavities 18*a* and 18*b* but is evenly distributed on the contact surfaces of the cavities 24*a*, 24*b* and of the projections 17*a* and 17*b* respectively.

KEY TO THE DRAWING

1—the voltage transformer
2—the enclosure
2*a*—the central element of the enclosure
2*b*—the base of the enclosure
2*c*—the side elements of the cast
2*d*—the side element of the base
3—the partition
4—the terminal box
5, 6—the complete terminals nn
7—the earthing terminal
8—the winding nn
9—the insulation tube
10—the core
11—the yoke
12—the bottom surface of the base 2*b*
13—the assembly elements
14—the circumferential sheds
15—the side sheds
16—the circumferential upper shed
17*a*, 17*b*—the projections
18*a*, 18*b*—the complete HV terminal
19*a*, 19*b*—the threaded hole
20—the HV winding
21—the carcass
22*a*, 22*b*—the bushings
23—the sheds of the bushings
24*a*, 24*b*—cavities
25*a*, 25*b*—the conductive rods
26*a*, 26*b*—the first connections
27*a*, 27*b*—the second connections
28—the sealing compound
29—the sockets
L—the length of the central element 2*a*
S—the Enter-shed spacing
α—the angle of inclination of the sheds
P1, P2—the overhang of the sheds
β—the angle of deviation of the bushings

The invention claimed is:

1. A double-pole voltage transformer enclosed in a tight enclosure made in a form of a resin cast comprising:

a central element integrated with a base and comprising circumferential sheds and two bushings situated above the circumferential sheds on the central element, the central element has a form of a circular cylinder situated with a side wall horizontally on the base, and the circumferential sheds are situated around the central element only in an area of a contact between the central element and the base, and above the circumferential sheds there are side elements of the cast forming side sheds which are integrated with front surfaces of the central element, and above the side sheds there is situated a circumferential top shed surrounding a fragment of the side wall of the central element, and the two bushings are detachably joined with the central element through projections respectively, which are situated above the circumferential top shed and have a shape of truncated cones integrated with the central element, in which projections complete HV terminals respectively are situated.

2. The transformer according to claim 1 wherein the central element is fitted with a partition having a shape of a segment of a round shed and adjoining an upper surface of the central element in a plane perpendicular to a longitudinal axis of the central element in a middle of a length "L" of the central element.

3. The transformer according to claim 1 wherein side walls of the base, situated along the side wall of the central element, are fitted with oblong sockets having a shape of semicircular longitudinal hollows.

4. The transformer according to claim 1 wherein the circumferential sheds, the side sheds and the circumferential top shed are situated parallel to one another and in planes parallel to a bottom surface of the base and the circumferential sheds, the side sheds and the circumferential top shed have a fixed inter-shed spacing "S" and an alternately variable overhang "P1", "P2" between the adjacent sheds.

5. The transformer according to claim 1, wherein longitudinal axes of the two bushings are divergent to one another and deviated from a vertical line in a plane parallel to planes of walls of the base by an angle β situated in a plane perpendicular to a bottom surface of the base.

6. The transformer according to claim 1, wherein the two bushings have in bottom parts centrally situated cavities in a shape of truncated cones, which corresponds to the shape of the projections of the central element, respectively.

7. The transformer according to claim 6, wherein contact surfaces between the projections and the cavities in the two bushings are sealed with an insulating and sealing compound.

* * * * *